US005381907A

United States Patent [19]

Stukuls

[11] Patent Number: 5,381,907

[45] Date of Patent: Jan. 17, 1995

[54] BOTTLE DISPLAY AND SECURE STORAGE RACK

[76] Inventor: Alfred Stukuls, 1127 Commonwealth Ave., Apartment 32, Allston, Mass. 02134

[21] Appl. No.: 60,407

[22] Filed: May 11, 1993

[51] Int. Cl.[6] ..... A47F 7/00

[52] U.S. Cl. ..... 211/74; 211/194

[58] Field of Search ..... 211/74, 76, 194, 189; 206/427

[56] References Cited

U.S. PATENT DOCUMENTS

| | | |
|---|---|---|
| 1,914,276 | 9/1931 | Moore . |
| 2,271,702 | 5/1941 | McCarthy . |
| 2,639,208 | 5/1948 | Obenchain . |
| 3,039,616 | 6/1962 | Proffit . |
| 3,166,192 | 2/1963 | Schultz et al. . |
| 3,779,414 | 5/1972 | Jones . |
| 3,993,452 | 7/1975 | Moulding . |
| 4,285,449 | 8/1981 | Campos . |
| 4,852,730 | 8/1989 | Thykeson . |
| 4,915,239 | 4/1990 | Persch . |

*Primary Examiner*—Alvin C. Chin-Shue
*Assistant Examiner*—Sarah L. Purol

[57] ABSTRACT

An individual container or a rack of containers for storing and displaying bottles in a secure manner. Each container is slightly longer in length and wider in width than the bottle to be displayed and stored; has a slot for viewing and handling the bottle slightly larger than the width of the bottle and slightly shorter in length than the bottle; each container has an aperture at the bottle neck end of the container slightly larger than the neck but smaller than the diameter of the bottle to be stored; and each container has a means to open and close the aperture and secure the aperture in the closed position. The bottle to be stored can only be inserted or withdrawn through the viewing and handling slot in the container provided the aperture is open to allow the bottle neck to be inserted into and through the aperture thus allowing the base and the body of the bottle to be positioned at an acute angle and maneuvered through the smaller length of the viewing and handling slot.

14 Claims, 6 Drawing Sheets

BOTTLE DISPLAY AND SECURE STORAGE RACK

FIELD OF THE INVENTION

The present invention relates to a container or a rack of containers for storing necked bottles for their display to the public in a manner that allows visibility and rotation of the bottle for scrutiny of its contents and labels but prevents its unauthorized removal from the container. The container or rack of containers can be provided with a mechanical, local or a remotely controlled mechanism to allow authorized withdrawal of the bottle from the container. While this invention is particularly useful for high quality bottled goods such as wines and champagne it is not restricted to such use and may also be used to display jewelry or other items that can be fit inside a bottle or can be displayed in transparent vessels that are designed to be used in the manner intended by the principals of this invention.

BACKGROUND OF THE INVENTION

Security of consumer goods to prevent their theft has been a problem of merchants since the ancient bazaars and open markets. Complicating the security issue is the need of the merchant to display his goods and allow the potential buyer the greatest access to inspect such goods in order that the buyer will be confident of the quantity and quality of the goods and thus consummate the purchase. Further complicating such security and inspection tradeoff is the possibility not of theft, vandalism and intentional contamination of the goods, but of damage to the goods, i.e., soiling, shop wear and breakage, by good intentioned but careless potential buyers. The aforementioned problems are of a particular concern to merchants of higher priced bottled goods such as wines and champagnes, liquors, and perfumes. It is also a need of the security factor to allow the merchant to store and secure his merchandise in a least offending manner so as to attract customers without exhibiting a distrustful environment.

Related art in secure bottle storage is disclosed in U.S. Pat. No. 2,271,702 in which milk bottles are secured in a lockable rack. The disclosed rack holds necked bottles but leaves exposed to potential vandalism their necked ends and such racks have a visible locking means conveying a strict impression of anti-theft rather than an impression of a quality goods display and inspection rack.

Related art in a module for housing containers and for forming a storing arrangement is disclosed in U.S. Pat. No. 4,285,449 in which necked bottles are stored in position by restricting the movement of the bottles in a rack by imposing a rotatable rack member against the neck portion of the bottle. In this invention the racks must have sufficient clearances to allow the bottle to be withdrawn longitudinally from the rack in the direction of the axis of the bottle and also does not protect the exposed bottles from vandalism or acts of intentional contamination. Other systems using lockable glass doors to secure bottles on shelves have the disadvantage of preventing direct and easy examination of the bottle and its contents and are more costly to construct and maintain.

The present invention solves the problem of storage and security while providing the potential customer with an ability to closely inspect the labels and commercial contents of the bottle in an environment lacking visibly apparent security controls. Therefore, it is the purpose of this invention to provide an enhanced display of the stored bottled goods to the customer while protecting the merchant's goods from pilfering, vandalism, contamination, inadvertent breakage and wear and tear.

SUMMARY OF THE INVENTION

The present invention is directed to the storage for display in an aesthetic yet secure manner for necked bottles and transparent necked bottle like shaped vessels. The invention utilizes a container, which may be a box, a cylinder, partially enclosed or fully enclosed in all but the viewing area but in all cases sufficiently enclosed to prevent a necked bottle from removal therefrom once it has been inserted therein in the manner provided by this invention. The container may be fabricated from wood, metal, plastic or any other suitable structurally strong material and fastened and secured together by conventional nails, screws or glue. The invention makes use of a closed container with a length slightly longer than the bottle to be displayed and having a viewing slot with a height greater in width than the diameter of the bottle and a length less in length than the bottle to be stored, an aperture in one end of such container larger than the diameter of the neck of a bottle but smaller than the diameter of the body of the bottle to allow only the neck of the bottle to be protruded through such aperture of the container. By protruding the bottle at an angle through the viewing slot while simultaneously protruding the neck through the aperture the bottle may be maneuvered through the slot into the interior of the container. Once the bottle is in the interior of the container the aperture is removed from communication with the bottle neck to prevent the reintroduction of the bottle neck into the aperture thus confining the bottle in the interior of the container. Because the bottle is greater in length than the viewing slot it cannot be maneuvered out of the viewing slot with the aperture closed. With the bottle secured it may be conveniently displayed and even handled through the viewing slot. The aperture can be moved in and out of communication by a variety of mechanisms which can be manually or remotely controlled.

The invention solves the problem of providing storage and security, allows no vandal access to the necked end of the bottle, provides convenient display and is simple enough in access and operation to allow the customers and merchants of the bottled goods to operate without complexity.

BRIEF DESCRIPTION OF THE DRAWINGS

The following is a brief description of the drawings.

DESCRIPTION OF THE PREFERRED EMBODIMENTS

Figure 1:
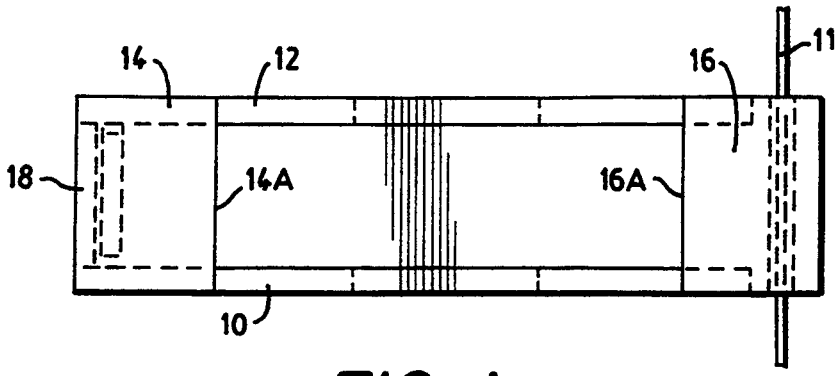
FIG. 1 is a side elevational view of a singular secure display container.

The secure display container side view shown in FIG. 1 has a base shelf 10, sides 14 and 16 fastened to and extending vertically from base shelf 10 and fastened to top shelf 12. End piece 18 closes the container at one end of the base shelf and aperture slide 11 is positioned at the end of the container opposite end piece 18. The distance between aperture slide 11 and end piece 18 is in the range of 10–20% longer than the length of the bottle to be displayed in the container. The distance between base shelf 10 and top shelf 12 is in the range of 10–50% greater than the largest diameter of the bottle to be displayed. The distance between the end 14A of first side 14 to the end of third side 16A is in the range of 50–80% of the length of the bottle to be displayed but in all cases the distance between 14A and 16A is always sufficiently less than the bottle to be displayed to prevent its removal if the aperture slide is in the "closed" position, i.e., the aperture of the aperture slide is not in communication with the bottle neck.

Figure 2:
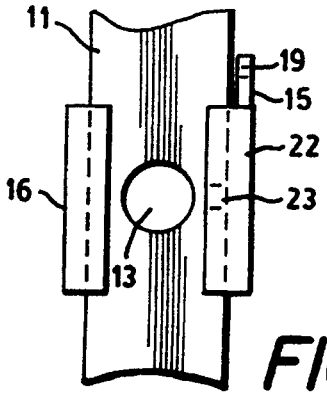
FIG. 2 is the aperture slide end elevational view of a singular secure display container.

In FIG. 2 the aperture slide 11 is shown with aperture 13 in the "open" position, i.e., the aperture is in communication with the bottle neck to allow insertion of the bottle neck 24. Also shown in FIG. 2 is the locking aperture 23, locking bracket 15 and locking bracket aperture 19.

Figure 3:
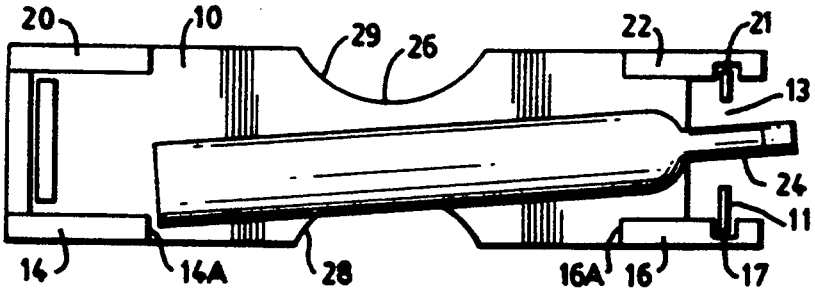
FIG. 3 is a top plan sectional view of a singular secure display container with the top of the container removed to more clearly depict the insertion sequence of guiding a bottle neck through the aperture and the bottle body through the viewing slot.

FIG. 3 depicts a top view of the container and the sequence of bottle 26 being maneuvered through the space between side ends 14A and 16A by protruding bottle neck 24 through aperture slide 13. Cutouts 28 and 29 facilitate the handling of the bottle during the performance of this maneuver and also provide an increased angle of viewing area of the goods to the consumer when multiple containers are stacked in racks at above and below eye level. Additionally shown in FIG. 3 are second side 20 and fourth side 22 and grooves 21 and 17 in sides 22 and 16 respectively for the locating and positioning of slide aperture 13.

Figure 4:
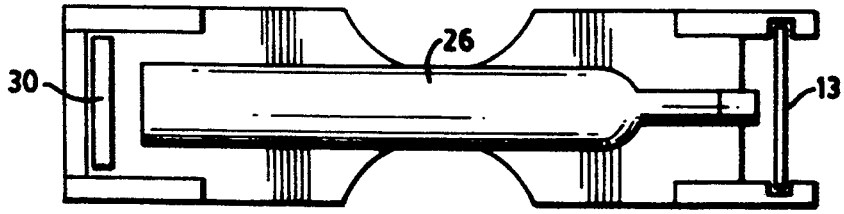
FIG. 4 is a top plan sectional view of a single secure display container with the top of the container removed and the aperture moved to the closed position to more clearly depict the bottle in the secure storage position.

FIG. 4 depicts the bottle 26 fully inserted into the secure display container with aperture slide 13 moved into the closed position. In this configuration the bottle can be viewed and handled but not removed. Also shown in FIG. 4 is spacer block 30 which can be inserted into the secure display container at the end opposite the aperture so the container may accommodate bottles of shorter length than the container was originally designed to accommodate.

Figure 5:
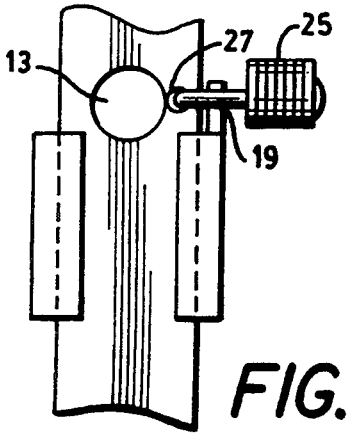
FIG. 5 is an end elevational view of the aperture slide of the secure display container moved into the secure position and locked with a conventional pad lock.

In FIG. 5 the aperture slide is shown in the closed position to prevent reinsertion of bottle neck 24 and thus prevent the manipulation for the removal of bottle 26. Common padlock 25 is also shown engaging locking bracket aperture 19 and locking aperture 23 in the aperture slide to secure the aperture slide in the closed position.

Figure 6:
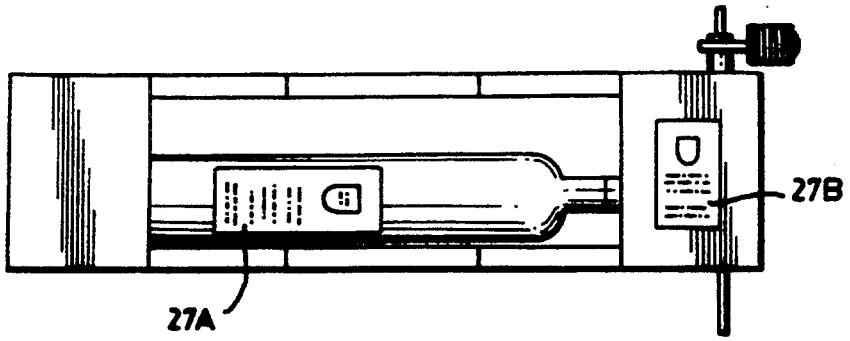
FIG. 6 is a side elevational view of a single secure display container with the bottled good secured in the display container.

FIG. 6 is a side view of a bottle in a secure display container with its label 27A shown for display and also a copy of the label 27B mounted on the secure display container for further ease and identification of the goods.

Figure 7:
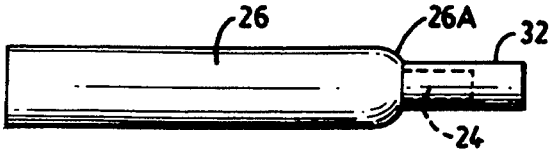
FIG. 7 illustrates the neck sleeve that may be fitted to effectively lengthen a short bottle.

FIG. 7 depicts bottle 26 with extender neck sleeve 32 covering bottle neck 24 and abutting bottle neck crown 26A. Extender neck sleeve 32 can be utilized in the same manner and with or without spacer block 30 to accommodate bottles of a shorter length than the container was originally designed to accommodate.

Figure 8:
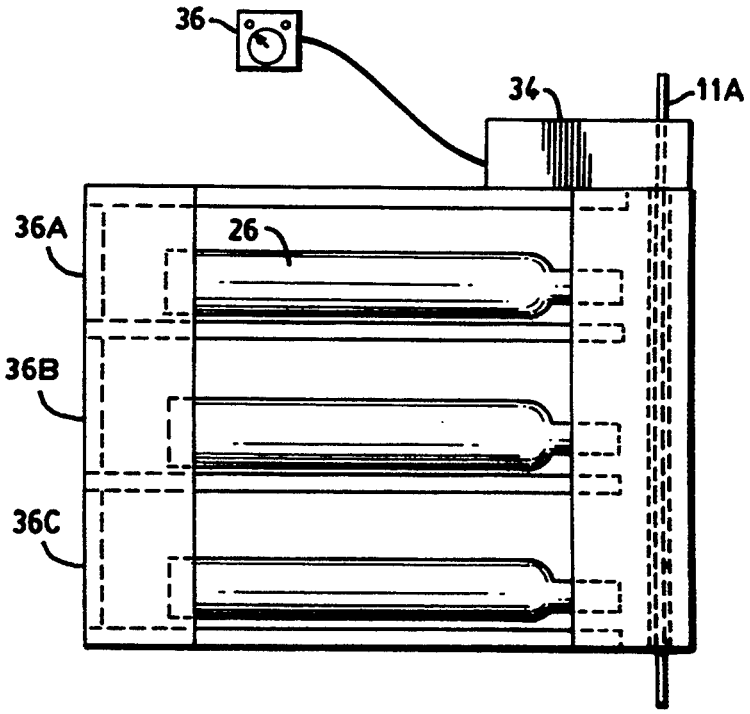
FIG. 8 is a side elevational view of a rack of secure containers with a remotely operated aperture slide control device.

FIG. 8 depicts a symmetrical vertical rack of secure storage containers 36A, 36B and 36C, an extended aperture slide 11A and an aperture slide control mechanism 34 with controller 36, such as a commercially available Warner Electric Electrack® 2000 programmable linear actuator and controller, for remote operation of the aperture slide. The vertical rack shown in FIG. 8 can also be positioned for display in a horizontal, upright or upside down manner.

Figure 9:
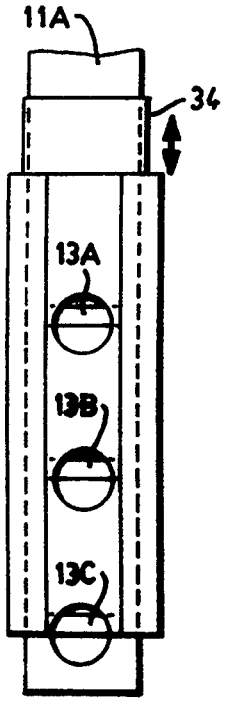
FIG. 9 is the aperture slide end elevational view of FIG. 8.

FIG. 9 depicts the end view of extended aperture slide 11A with aperture 13A, 13B and 13C in the closed position.

Figure 10:
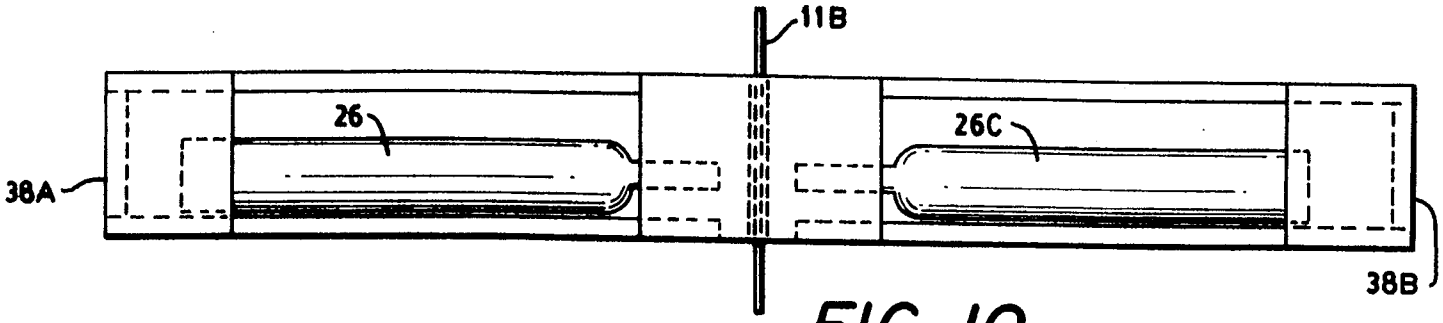
FIG. 10 is a side elevational view of directly opposed storage containers with a single aperture slide.

FIG. 10 depicts tangentially opposed secure storage containers having a common slide aperture 11B. The length, 10–20% greater than the bottle length of each container allows sufficient room for the extension of the bottle neck through the aperture to permit the maneuvering of one bottle at a time from the secure display containers.

Figure 11:
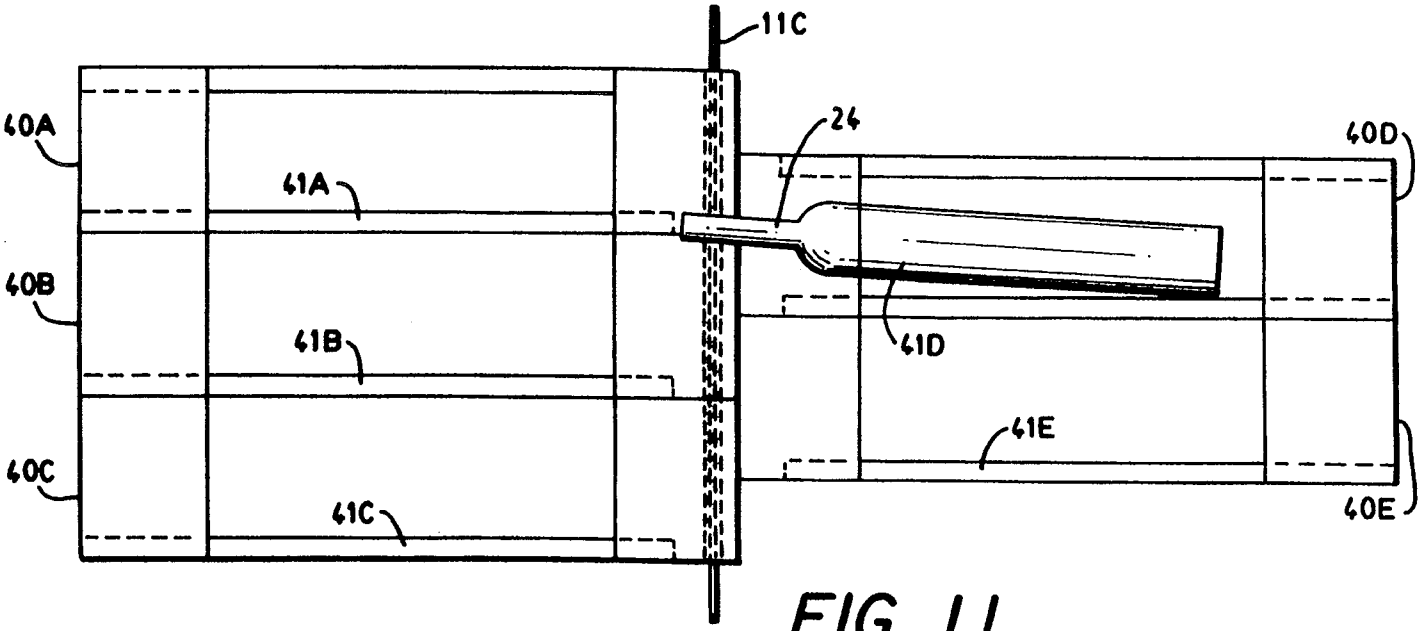
FIG. 11 is a side elevational view of offset and opposed storage containers with a single aperture slide.

FIG. 11 shows a rack of offset opposed secure display containers 40A, 40B, 40C, 40D, and 40E having a common aperture slide 11C. The design length of shelves 41A, 41B, 41C, 41D and 41E are calculated and built to allow bottle neck 24 to be protruded through the aperture slide sufficiently to allow the insertion and removal of the bottle from the secure display container in the manner as depicted in FIG. 3.

Figure 12:
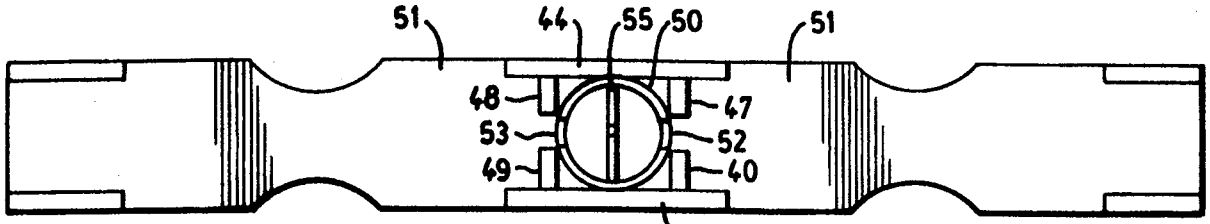
FIG. 12 is a top plan sectional view with the top shelf removed of directly opposed storage containers with a cylindrical aperture device.
Figure 13:
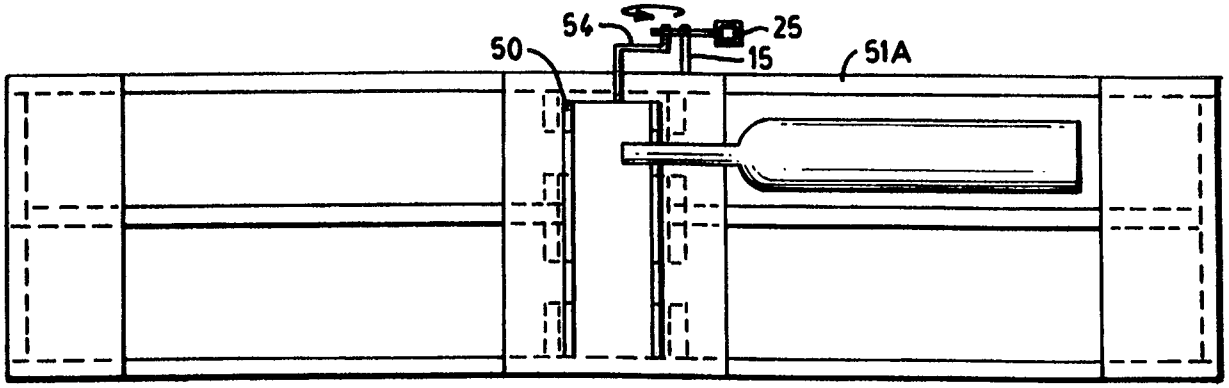
FIG. 13 is a side sectional elevation view of FIG. 12.

FIG. 12 depicts the top sectional view of tangential opposed secure display containers having a common cylindrical aperture device 50 held in a rotatable position by vertical sides 44 and 45 and interior vertical side projections 46, 47, 48 and 49 and base shelf 51 and top shelf 51A as shown in FIG. 13. The cylindrical aperture device has cross member 55 for attaching crank handle 54 shown in FIG. 13 to rotate the cylindrical aperture device to align apertures 52 and 53 in the open or close position in order to insert or secure a bottle or bottles. The cylindrical aperture device can be constructed with only one aperture 52 if desired.

FIG. 13 depicts a rack of secure storage containers with a common cylindrical aperture device and a locking bracket 15A and padlock 25A for securing crank handle 54.

Figure 14:
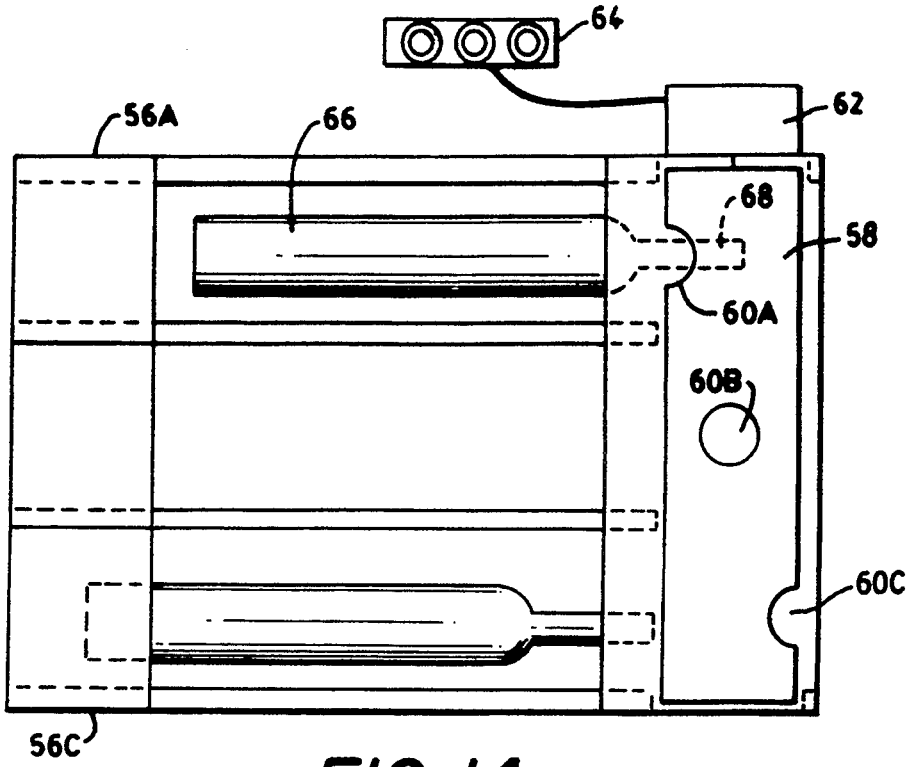
FIG. 14 is a side sectional elevation view of an offset and opposed storage containers with a remotely operated cylindrical aperture device with helically positioned apertures.

FIG. 14 depicts a rack of secure storage containers with a cylindrical aperture device wherein the apertures 60A, 60B and 60C are arranged in a helical manner in order to allow the removal or insertion of only one bottle from the rack at a time. FIG.14 also depicts remote control mechanism 62 and controller 64, such as a commercially available Mavilor® Servo positioning motor and digital controller.

Figure 15:
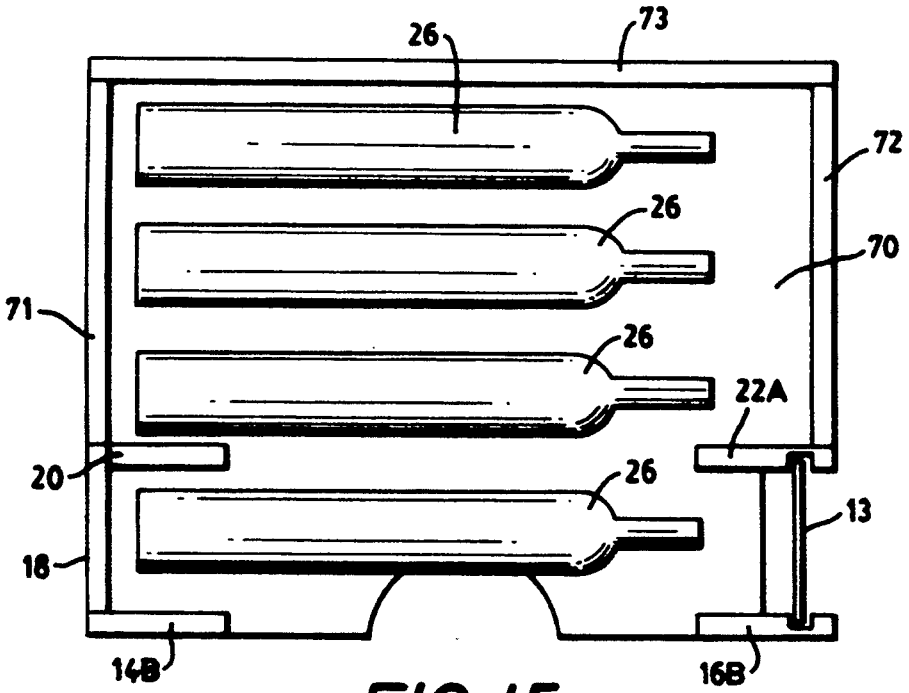
FIG. 15 is a top plan sectional view with the top shelf removed of a container with a storage capacity for reserve bottles.

FIG. 15 is a secure storage container with an integrated and extended base shelf compartment 70 and sides 71, 72 and rear side 73 to allow for additional space for bottle storage. The top shelf is not shown in this figure but is similar to base shelf 70 and is secured to sides 71, 72 and 73. In FIG. 15 the bottle in the secure storage container prevents removal of the bottles in the extended base shelf compartment.

Figure 16:
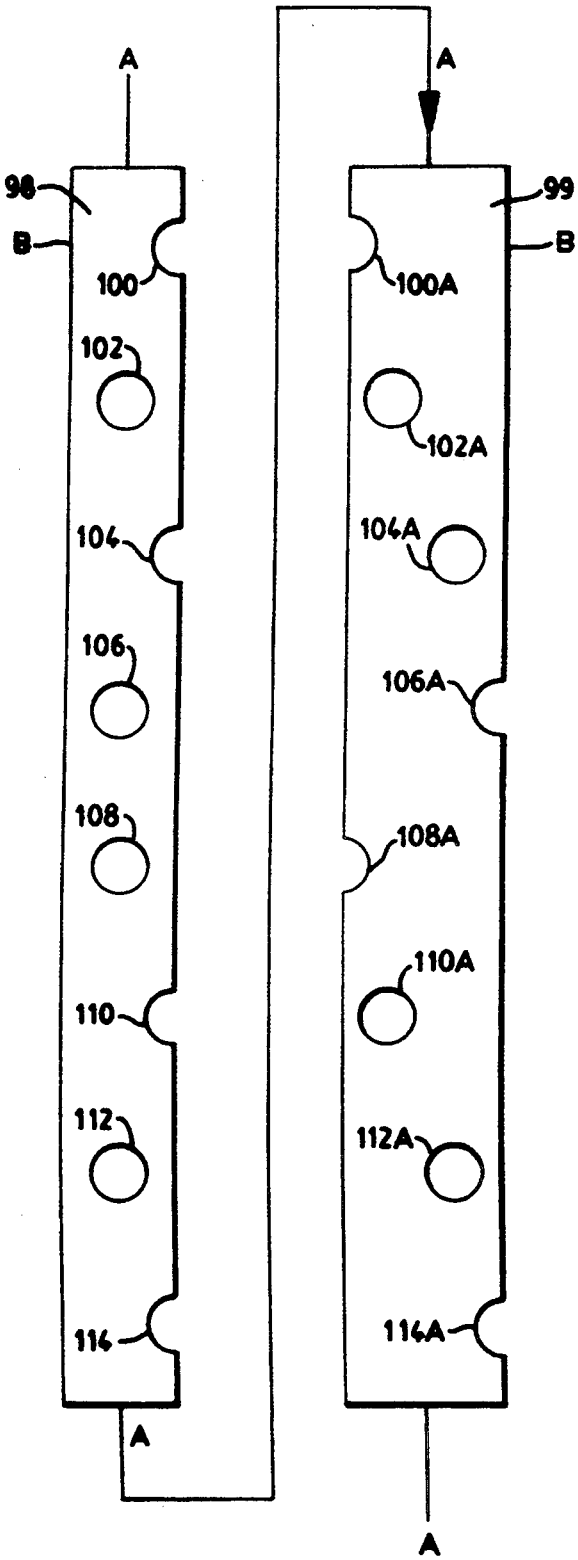
FIG. 16 is an exploded view of a cylindrical aperture device with an internal ported security cylinder along common axis A.

FIG. 16 is a cylindrical aperture device 99 with apertures 100A, 102A, 104A, 106A, 110A, 112A and 114A arranged in a helical manner similar to FIG. 14. FIG. 16 also shows an internal ported security cylinder 98 with security apertures 100, 102, 104, 106, 108, 110, 112 and 114 arranged in a manner that when the internal ported security cylinder is inserted axially, A—A, inside the cylindrical aperture device 99 and aligned vertically in order that ports 100 and 100A are on the same plane, B—B, that only one port of the cylindrical aperture device is open at one time. Rotating the cylindrical aperture device to the desired container must be accompanied by also rotating the internal ported security cylinder to the corresponding open position. The combination of the cylindrical aperture device and the internal ported security cylinder allow for only one selected container to be accessed even though the cylindrical aperture devices other apertures may be in the open position to other containers but are blocked by the internal ported security cylinder until the security cylinder is positioned to allow access.

Figure 17:
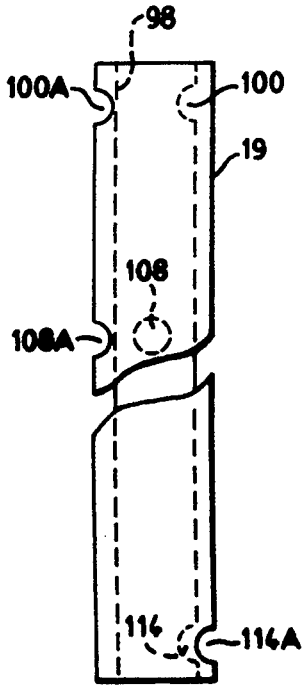
FIG. 17 is a partial sectional view of FIG. 16 illustrating the sequencing of the cylindrical aperture device with the internal ported security cylinder.

FIG. 17 depicts an example of the availability of aperture 114A for use as aperture 114 the security cylinder is properly positioned. Apertures 100A and 108A are in the open position for use but are blocked by the security cylinder whose corresponding ports 100 and 108 respectively are in the closed position. The internal ported security cylinder provides for the use of a multiple ported cylindrical aperture device in a rack of containers in a manner that allows only one container to be accessed at a time.

While particular embodiments of the invention have been shown and described, other embodiments will be apparent to those skilled in the art, and therefore it is not intended that the invention be limited to the disclosed embodiments or to the details thereof, and departures may be made therefrom within the spirit and scope of the invention.

What is claimed is:

1. A container for storing and displaying a bottle comprising:

a base shelf for holding a bottle to be displayed, the bottle having neck end and a base end and the base shelf having a length in the range of 10–20% greater than said bottle;

an end piece fastened vertically to one end of the base shelf to restrain the base end of the bottle from movement on the base shelf in the direction of the end piece;

a first and second side fastened vertically to the end piece of the base shelf for restraining the base end of the bottle from movement on the base shelf in the in the direction of the first and second sides said first side having a first side end and said second side having a second side end;

a third and fourth side fastened vertically to the end of the base shelf opposite from the end piece, each said third and fourth side having symmetrically located vertical grooves on the inside side of said third and fourth sides and each third and fourth side end being a distance respectively equal to between 50 and 80% of the length of the bottle to be stored from the side ends of the first and second sides;

a movable aperture slide positioned in the vertical grooves of the third and fourth side said movable aperture slide having an aperture 10–20% larger than the neck of the bottle to be stored for projecting the bottle neck through said aperture in order to allow the base of the bottle to clear the first and second side ends so that the bottle may be placed in or removed from the interior of the container; and a top shelf secured to the first side and the third side to restrain the bottle from removal from the container in the direction of the top shelf.

2. A container as recited in claim 1 wherein the movable aperture slide is moved into the open and closed position by a remotely controlled mechanism.

3. A container as recited in claim 1 wherein the base shelf, end piece, top shelf and sides of the container are extended in length to make the interior of the container larger in order to provide for a storage space therein for reserve bottles.

4. A container for storing and displaying a bottle comprising:

a base shelf for holding a bottle to be displayed, the bottle having a neck end and a base end and the base shelf having a length in the range of 10–20% greater than the bottle;

an end piece fastened vertically to one end of the base shelf to restrain the base end of the bottle from movement on the base shelf in the direction of the end piece;

a first and second side fastened vertically to the end piece of the base shelf for restraining the base end of the bottle from movement on the base shelf in the direction of the first and second sides, said first side having a first side end and said second side having a second side end;

a third and fourth side fastened vertically to the end of the base shelf opposite from the end piece, said third and fourth side each having two spaced interior vertical side projections extending inwardly, said third side having a third side end and said fourth side having a fourth side end, and each third and fourth side being a distance respectively equal to between 50 and 80% of the length of the bottle to be stored from the side end of the first and second side end;

a rotatable cylindrical aperture device positioned between the interior sides of the third and fourth side and the spaced interior vertical side projections said rotatable cylindrical aperture device having an aperture 10–20% larger than the neck of the bottle to be stored for projecting the bottle neck through in order to allow the base of the bottle to clear the first and second side ends and be placed in the container; and a top shelf secured to the first side and the third side to restrain the bottle from removal from the container in the direction of the top shelf.

5. A container as recited in claim 4 wherein the rotatable cylindrical aperture device is rotated into the open and closed position by a remotely controlled mechanism.

6. A container as recited in claim 4 wherein an internal ported security cylinder having a plurality of apertures in positions on the security cylinder to allow access to only one container at a time is positioned axially in the bore of the rotatable cylindrical aperture device to provide increased security of the goods in multiple container racks.

7. A container as recited in claim 4 wherein the base shelf, end piece, top shelf sides and sides are extended in length to make the interior of the container larger in order to provide for a storage space for reserve bottles.

8. A system of multiple containers for storing and displaying bottles comprising:

a plurality of containers for storing and displaying bottles symmetrically connected to each other in a manner that the base shelf of one container functions as the top shelf of a companion container and the aperture slide grooves of each container are aligned to receive the aperture slide; and a movable extended common aperture slide with a corresponding aperture for each of the plurality of containers to allow the bottle necks to be inserted into the aperture for maneuvering the bottle into the containers.

9. A system of multiple containers for storing and displaying bottles comprising:

a plurality of containers for storing and displaying bottles symmetrically connected to each other in a manner that the base shelf of one container functions as the top shelf of its companion container and the interior vertical side projections of each container are aligned to receive a rotatable cylindrical aperture device; and an extended common rotatable cylindrical aperture device with a corresponding aperture for each of the plurality of containers to allow the bottle necks to be inserted into the aperture for maneuvering the bottle into the interior of the containers.

10. A container for storing and displaying a bottle comprising:

a base shelf for holding a bottle to be displayed, the bottle having neck end and a base end and the base shelf having a length in the range of 10–20% greater than said bottle;

an end piece fastened vertically to one end of the base shelf to restrain the base end of the bottle from movement on the base shelf in the direction of the end piece;

a first and second side fastened vertically to the end piece of the base shelf for restraining the base end of the bottle from movement on the base shelf in the in the direction of the first and second sides said first side having a first side end and said second side having a second side end;

a third and fourth side fastened vertically to the end of the base shelf opposite from the end piece, each said third and fourth side having symmetrically located vertical grooves on the inside side of said third and fourth sides and each third and fourth side end being a distance respectively equal to between 50 and 80% of the length of the bottle to be stored from the side ends of the first and second sides;

a remotely controlled movable aperture slide positioned in the vertical grooves of the third and fourth side said movable aperture slide having an aperture 10–20% larger than the neck of the bottle to be stored for projecting the bottle neck through said aperture in order to allow the base of the bottle to clear the first and second side ends so that the bottle may be placed in or removed from the interior of the container; and a top shelf secured to the first side and the third side to restrain the bottle from removal from the container in the direction of the top shelf.

11. A container for storing and displaying a bottle comprising:

a base shelf for holding a bottle to be displayed, the bottle having neck end and a base end and the base shelf having a length in the range of 10–20% greater than said bottle;

an end piece fastened vertically to one end of the base shelf to restrain the base end of the bottle from movement on the base shelf in the direction of the end piece;

a first and second side fastened vertically to the end piece of the base shelf for restraining the base end of the bottle from movement on the base shelf in the in the direction of the first and second sides said first side having a first side end and said second side having a second side end;

a third and fourth side fastened vertically to the end of the base shelf opposite from the end piece, each said third and fourth side having symmetrically located vertical grooves on the inside side of said third and fourth sides and each third and fourth side end being a distance respectively equal to between 50 and 80% of the length of the bottle to be stored from the side ends of the first and second sides;

a movable aperture slide positioned in the vertical grooves of the third and fourth side said movable aperture slide having an aperture 10–20% larger than the neck of the bottle to be stored for projecting the bottle neck through said aperture in order to allow the base of the bottle to clear the first and second side ends so that the bottle may be placed in or removed from the interior of the container;

a top shelf secured to the first side and the third sides to restrain the bottle from removal from the container in the direction of the top shelf; and an extended base shelf compartment extending from the second and third sides of the container to allow for the storage of reserve bottles.

12. A container for storing and displaying a bottle comprising:

a base shelf for holding a bottle to be displayed, the bottle having a neck end and a base end and the base shelf having a length in the range of 10–20% greater than the bottle;

an end piece fastened vertically to one end of the base shelf to restrain the base end of the bottle from movement on the base shelf in the direction of the end piece;

a first and second side fastened vertically to the end piece of the base shelf for restraining the base end of the bottle from movement on the base shelf in the direction of the first and second sides, said first side having a first side end and said second side having a second side end;

a third and fourth side fastened vertically to the end of the base shelf opposite from the end piece, said third and fourth side each having two spaced interior vertical side projections extending inwardly, said third side having a third side end and said fourth side having a fourth side end, and each third and fourth side being a distance respectively equal to between 50 and 80% of the length of the bottle to be stored from the side end of the first and second side end;

a remotely controlled rotatable cylindrical aperture device positioned between the interior sides of the third and fourth side and the spaced interior vertical side projections said rotatable cylindrical aperture device having an aperture 10–20% larger than the neck of the bottle to be stored for projecting the bottle neck through in order to allow the base of the bottle to clear the first and second side ends and be placed in the container; and a top shelf secured to the first side and the third side to restrain the bottle from removal from the container in the direction of the top shelf.

13. A container for storing and displaying a bottle comprising:

a base shelf for holding a bottle to be displayed, the bottle having a neck end and a base end and the base shelf having a length in the range of 10–20% greater than the bottle;

an end piece fastened vertically to one end of the base shelf to restrain the base end of the bottle from movement on the base shelf in the direction of the end piece;

a first and second side fastened vertically to the end piece of the base shelf for restraining the base end of the bottle from movement on the base shelf in the direction of the first and second sides, said first side having a first side end and said second side having a second side end;

a third and fourth side fastened vertically to the end of the base shelf opposite from the end piece, said third and fourth side each having two spaced interior vertical side projections extending inwardly, said third side having a third side end and said fourth side having a fourth side end, and each third and fourth side being a distance respectively equal to between 50 and 80% of the length of the bottle to be stored from the side end of the first and second side end;

a rotatable cylindrical aperture device positioned between the interior sides of the third and fourth side and the spaced interior vertical side projections said rotatable cylindrical aperture device having an aperture 10–20% larger than the neck of the bottle to be stored for projecting the bottle neck through in order to allow the base of the bottle to clear the first and second side ends and be placed in the container, the rotatable cylindrical aperature device having a rotatable internal ported security cylinder positioned axially in the bore of the rotatable cylindrical aperture device, the security cylinder ports configured such that only one of the apertures of the rotatable cylinder aperature device and one of the ports of the security cylinder may be in alignment at one time so as to allow access to only one container at a time to provide increased security of the goods in multiple container racks;

a top shelf secured to the first side and the third side to restrain the bottle from removal from the container in the direction of the top shelf.

14. A container for storing and displaying a bottle comprising:

a base shelf for holding a bottle to be displayed, the bottle having a neck end and a base end and the base shelf having a length in the range of 10–20% greater than the bottle;

an end piece fastened vertically to one end of the base shelf to restrain the base end of the bottle from movement on the base shelf in the direction of the end piece;

a first and second side fastened vertically to the end piece of the base shelf for restraining the base end of the bottle from movement on the base shelf in the direction of the first and second sides, said first side having a first side end and said second side having a second side end;

a third and fourth side fastened vertically to the end of the base shelf opposite from the end piece, said third and fourth side each having two spaced interior vertical side projections extending inwardly, said third side having a third side end and said fourth side having a fourth side end, and each third and fourth side being a distance respectively equal to between 50 and 80% of the length of the bottle to be stored from the side end of the first and second side end;

a rotatable cylindrical aperture device positioned between the interior sides of the third and fourth side and the spaced interior vertical side projections said rotatable cylindrical aperture device having an aperture 10–20% larger than the neck of the bottle to be stored for projecting the bottle neck through in order to allow the base of the bottle to clear the first and second side ends and be placed in the container;

a top shelf secured to the first side and the third side to restrain the bottle from removal from the container in the direction of the top shelf; and an extended base shelf compartment extending from the second and third sides of the container to allow for storage of reserve bottles.

* * * * *